US006050789A

United States Patent [19]

Melby et al.

[11] Patent Number: 6,050,789

[45] Date of Patent: Apr. 18, 2000

[54] PUMP-IN-PIPE

[76] Inventors: James H. Melby, 19606 Fish Hill La., Redding, Calif. 96003; Donald B. Carter, P.O. Box 63, Anderson, Calif. 96007

[21] Appl. No.: 08/974,867

[22] Filed: Nov. 20, 1997

Related U.S. Application Data

[63] Continuation of application No. 08/591,354, Jan. 25, 1996, abandoned.

[51] Int. Cl.[7] ..... F04B 35/04

[52] U.S. Cl. ..... 417/423.15; 417/424.1; 417/424.2; 66/101

[58] Field of Search ..... 417/424.1, 424.2, 417/423.15; 66/101

[56] References Cited

U.S. PATENT DOCUMENTS

| | | | |
|---|---|---|---|
| 2,843,052 | 7/1958 | Andrus | 166/63 |
| 3,800,870 | 4/1974 | Pitts, Jr. | 166/65 R |
| 4,152,097 | 5/1979 | Woodard | 417/360 |
| 4,541,782 | 9/1985 | Mohn | 417/244 |
| 4,992,030 | 2/1991 | Hasslen, III | 417/360 |

*Primary Examiner*—Charles G. Freay
*Assistant Examiner*—Ehud Gartenberg

[57] ABSTRACT

Adapter for installing deep-well submersible pump with a motor in casings with inflatable seal means comprising an annular inflatable tubular bladder with pipe flow-through means, communicating with the pump; adapter and pump suspended by cable means and air pressure line means, communicating with bladder so that it can contact the cylindrical casing; and with electric cable power means communicating with pump motor and with guide wheels to negotiate curves and reduce friction on sloping casings.

1 Claim, 1 Drawing Sheet

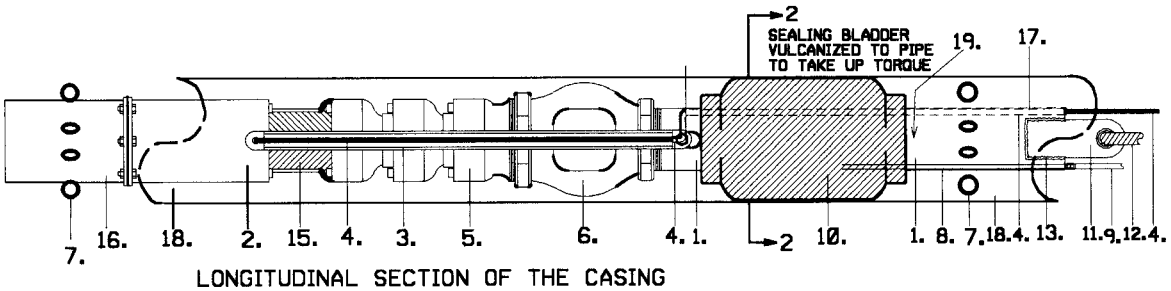

LONGITUDINAL SECTION OF THE CASING

PUMP-IN-PIPE

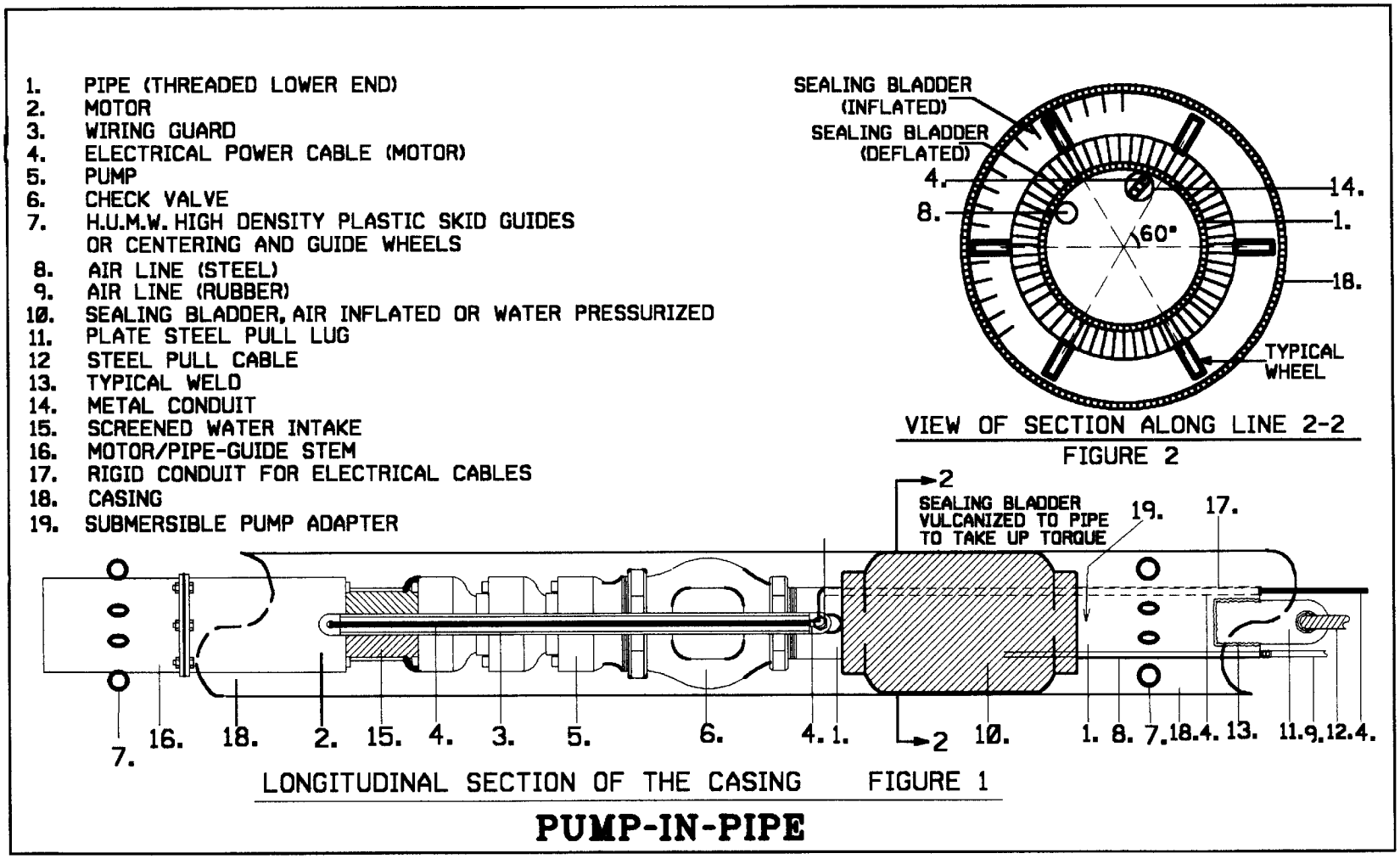
1. PIPE (THREADED LOWER END)
2. MOTOR
3. WIRING GUARD
4. ELECTRICAL POWER CABLE (MOTOR)
5. PUMP
6. CHECK VALVE
7. H.U.M.W. HIGH DENSITY PLASTIC SKID GUIDES OR CENTERING AND GUIDE WHEELS
8. AIR LINE (STEEL)
9. AIR LINE (RUBBER)
10. SEALING BLADDER, AIR INFLATED OR WATER PRESSURIZED
11. PLATE STEEL PULL LUG
12 STEEL PULL CABLE
13. TYPICAL WELD
14. METAL CONDUIT
15. SCREENED WATER INTAKE
16. MOTOR/PIPE-GUIDE STEM
17. RIGID CONDUIT FOR ELECTRICAL CABLES
18. CASING
19. SUBMERSIBLE PUMP ADAPTER
SEALING BLADDER (INFLATED)
SEALING BLADDER (DEFLATED)
TYPICAL WHEEL
60°
VIEW OF SECTION ALONG LINE 2-2
FIGURE 2
SEALING BLADDER VULCANIZED TO PIPE TO TAKE UP TORQUE
LONGITUDINAL SECTION OF THE CASING
FIGURE 1
PUMP-IN-PIPE

PUMP-IN-PIPE

This is a continuation of application Ser. No. 08/591,354, filed Jan. 25, 1996, now abandoned.

BACKGROUND OF THE INVENTION

1. Field of the Invention

The present invention relates to deep-well submersible pump and more particularly to ones in which a pump is lowered down a casing resting on sloping lake bottom to pump water to the shoreline.

2. Background

Systems using a submersible pump with a motor installed in a casing depend on the casing to contain the pump and motor. They also use a pipe installed in the casing to convey the fluid from the pump to the point of delivery. The motor torque is restrained by the pipe.

A mechanical wedging system is an alternative used to restrain the motor torque in the casing.

Current deep well installations also use shaft-driven submerged pumps with the motor placed above ground. These systems require the removal of the pipe and drive shaft to remove the pump for repair and servicing. The same difficulties associated with removal are experienced with installation.

An example of prior art deep well adapters with inflatable seal means is described in U.S. Pat. No. 2,843,052 to Andrus. The device described relies on a precharged gas chamber that is lowered into a well casing with an inflatable seal with heat actuated fusible plug valves to inflate and deflate this seal. Heat for fusion is an electrical element with the control switch at the top of the well. The Andrus device is more complex than our invention in that it has a submerged gas chamber and an inflatable bladder whereas our invention has only the inflatable bladder in the well to effect the seal and torsion restraint. Although our device has an air supply line that is not required on the Andrus device, it is less costly and has a major advantage. If the fusible plug fails to function to deflate the bladder there is no economical way to remove the pump system, especially in our preferred embodiment where the casing is on a slope and is not straight. Access to the head of the casing on lakeshore installations is often limited by steep terrain which also precludes the use of conventional pump retrieval equipment.

Furthermore, Andrus has no provision for installing his device in a sloped casing. Our device provides wheels. Also, the Andrus device cannot be relocated in the casing without complete removal from the well and recharging the gas chamber.

It is apparent from Andrus' diagram that the cylinder containing the inflatable tube and gas chamber casting could bind against the casing wall if said casing has dents or other surface irregularities. Dents and surface irregularities are common in lake casing installations.

Another weakness of the Andrus device is that deflation, according to the diagram, is by the gas escaping into the casing where the water pressure is equal to the pressure on the sealing tube. This would not allow a complete deflation and could cause removal problems.

SUMMARY OF THE INVENTION

The present invention provides an improved adapter for deep well type submersible pump with motor in casing suitable for lake-bottom installation and the like. The present invention is characterized by the provision of a single device with wheels for ease of placing a pump with motor in the well casing with adapter means that can be inflated and controlled from above the lake surface so as to properly dispose the pump at the desired depth in the lake.

In accordance with one aspect of the present invention there is provided an adapter with inflatable bladder means for positioning a submersible with motor at desired location in the well casing which eliminates an inner pipe in wells used heretofore.

In accordance with another aspect of the present invention, there is provided an adapter for deep well casing that can position the pump at a desired location in the casing by simple inflatable means which can be deflated and the pump with motor can be pulled up without disconnecting each length of the pipe disposed in casings used heretofore.

In accordance with still a further aspect of the present invention there is provided an adapter upon which is disposed a pump with motor for pumping water from a lake and which requires pulling up the adapter assembly by reeling up the suspension cable when it is desired to withdraw the pump from the casing.

In accordance with yet another aspect of the present invention there is provided an adapter with inflatable bladder means to locate the pump in the desired position and in which the entire area of the casing is utilized to flow water upward from the adapter to the lake shore.

Another aspect of the present invention is to provide an adapter for deep well type casing with inflatable bladder means to stabilize the pump with motor assembly and prevent rotation of said assembly in the casing and to seal the casing to prevent return flow around the adapter.

Those skilled in the art will recognize the above described features and advantages of the present invention together with other superior aspects thereof upon reading the detailed description which follows in conjunction with the drawing.

BRIEF DESCRIPTION OF THE DRAWING

FIG. 1 is a longitudinal section of the casing which includes therein the apparatus of the present invention illustrated in a schematic form.

FIG. 2 is the view of a section taken along the line 2—2 of FIG. 1.

DESCRIPTION OF PREFERRED EMBODIMENT

In the description which follows like parts are marked throughout the specification and drawing with the same reference numerals respectively. The drawing figures are not necessarily to scale and certain features are shown in somewhat schematic form in the interest of clarity and conciseness.

Referring to FIG. 1 there is illustrated a section of the deep well type casing 18, disposed on the lake bottom, and in which water is disposed and in which is disposed a submersible pump adapter in accordance with the present invention and generally designated by numeral 19. The submersible pump adapter 19 comprises an axially disposed pipe 1 with threaded lower end that extends upward and through an air-inflated sealing bladder 10; air supply line 8, communicating with the bladder 10; pull lug 11, with weld 13, connection means to the upper end of the pipe 1; a pull cable 12; and wheel guides 7.

The pipe 1 by thread means is secured to a submersible pump assembly comprising a check valve 6, pump 5, wire guard 3, water intake screen 15, motor 2, and motor/pipe guide stem 16, with wheel guides 7.

The sealing bladder 10 is synthetic rubber bonded to pipe 1 by vulcanizing means and is shown in the inflated position in FIG. 1. FIG. 2 is a section through the casing 18, the bladder 10, and pipe 1, designated by line 2—2 in FIG. 1.

Referring to FIG. 2, which shows the air supply (steel) 8, disposed inside pipe 1 and communicating with the inflatable bladder 10. The air line (steel) 8, transitions to air line (rubber) 9 at the upper end of the pipe 1. Air line 9, disposed in the casing 18, extends to an air supply device at the upper end of casing 18.

FIG. 2 further shows the electric power cable 4 in metal conduit 14 disposed in the pipe 1 which communicates with the electric pump motor 2, and a power source at the upper end of the casing 18. FIG. 2 still further shows the sealing bladder 10 disposed in the inflated position and in the deflated position with respect to the casing 18.

The purpose of the submersible pump adapter 19 is to maintain the pump with motor in the casing at the desired depth in the lake.

The operation of the present invention follows:
The pump, and connected parts numerals 1 through 18, is lowered in the casing 18 to a predetermined depth therein. Air is supplied through air lines 8 and 9, and is pumped into the inflatable bladder 10. This will inflate the bladder 10, with sufficient pressure to expand it outwardly. The bladder 10 thus firmly contacts the inside of the casing 18 with sufficient force to maintain the pump at the desired depth. Thus the pump will be maintained at this depth until it is desired to move it to a new level.

Should it be necessary to replace the pump 5, or motor 2, it is only necessary to deflate the bladder 10 by releasing the pressurized air at the upper end of the casing 18. The bladder 10 will no longer contact the casing 18. Removal is then performed by pulling cable 12 together with the electric cable 4 and rubber air line 9.

The expansion of the bladder 10 stabilizes the assemble and prevents its rotation in the casing 18. It further seals the annular space between the pipe 1 and the casing 18 to prevent return flow around the adapter 19.

Thus from the foregoing description it is apparent that the present invention provides a submersible pump adapter with a single inflatable seal means so as to eliminate the necessity for an inner pipe and allow the use of casing as a larger conduit of water flow and which can be readily positioned at any desired depth. Another advantage of the present invention is that the inflatable seal prevents rotation of the pump assembly by firm contact with the inside of the casing. With conventional pump installations the pump is screwed into a sleeve at the bottom of the inner pipe which extends to the upper end of the casing where it is anchored to prevent rotation and change in depth of the pump assembly.

While the preferred embodiment of the invention has been shown and described, it will be apparent to those skilled in the art that changes can be made in this embodiment without departing from the principals and spirit of the invention, the scope of which is defined in the appended claim. For example, although in the preferred embodiment the bladder is expanded by air inflation, the bladder can be expanded by hydraulic means thus eliminating the need for an air compressor at the well head.

What I claim is:

1. An adapter for installation of a deep-well submersible pump with motor in a cylindrical casing, said adapter having sealing, rotational and translational restraint means; comprising pipe members with guide wheel means for ease of installation in curved and sloping casings, suspended by flexible cable means and carrying the pump and the motor attached to an inflatable tubular bladder, and a flexible air line supply means adjacent and connected to said flexible cable and communicating with the inflatable bladder to inflate said bladder so that it contacts the cylindrical casing in which it is disposed; wherein:

said sealing, rotational and translational restraint means is said inflatable tubular bladder; and, said pump pumps fluid to a lake shore through said casing.

* * * * *